US010673186B2

(12) United States Patent
Gilliland et al.

(10) Patent No.: US 10,673,186 B2
(45) Date of Patent: Jun. 2, 2020

(54) ELECTRICAL CORD HAVING PLUGS MULTI-FUNCTIONAL LIGHT INDICATORS

(71) Applicant: Solid Ground Cords, LLC, Knoxville, TN (US)

(72) Inventors: Lester Richard Gilliland, Knoxville, TN (US); Davis W. Ratcliff, Ocoee, TN (US)

(73) Assignee: Solid Ground Cords, LLC, Knoxville, TN (US)

( * ) Notice: Subject to any disclaimer, the term of this patent is extended or adjusted under 35 U.S.C. 154(b) by 0 days.

(21) Appl. No.: 16/374,415

(22) Filed: Apr. 3, 2019

(65) Prior Publication Data

US 2019/0296503 A1 Sep. 26, 2019

Related U.S. Application Data

(63) Continuation-in-part of application No. 15/723,965, filed on Oct. 3, 2017, now Pat. No. 10,297,959, which is a continuation-in-part of application No. 15/412,336, filed on Jan. 23, 2017, now Pat. No. 9,941,638, which is a continuation-in-part of application No. 15/152,076, filed on May 11, 2016, now Pat. No. 9,716,352.

(60) Provisional application No. 62/281,467, filed on Jan. 21, 2016, provisional application No. 62/318,492, filed on Apr. 5, 2016.

(51) Int. Cl.

| | |
|---|---|
| ***H01R 13/717*** | (2006.01) |
| ***H01R 13/66*** | (2006.01) |
| ***H01R 4/56*** | (2006.01) |
| ***H01R 103/00*** | (2006.01) |

(52) U.S. Cl.

CPC ..... *H01R 13/7175* (2013.01); *H01R 4/56* (2013.01); *H01R 13/6616* (2013.01); *H01R 13/6641* (2013.01); *H01R 2103/00* (2013.01)

(58) Field of Classification Search

CPC ..... H01R 13/652; H01R 13/717; H01R 13/7175; H01R 13/7171; H01R 13/641; H01R 13/64; H01R 13/04; H01R 13/42; H01R 13/10; H01R 13/6616; H01R 13/6641; H01R 31/06; H01R 24/30; H01R 24/22; H01R 2103/00; H01R 4/56

USPC ..... 439/103, 104, 490, 502

See application file for complete search history.

(56) References Cited

U.S. PATENT DOCUMENTS

| | | | |
|---|---|---|---|
| 2,495,206 | A | 1/1950 | Brus |
| 2,528,971 | A | 11/1950 | Raymond |
| 2,984,808 | A | 5/1961 | Bender |
| 3,293,591 | A | 12/1966 | Mayer, Jr. |

(Continued)

*Primary Examiner* — Gary F Paumen

(74) *Attorney, Agent, or Firm* — Pitts & Lake, P.C.

(57) ABSTRACT

An electrical cord having improved safety features comprises a plug having a body portion surrounding respective ends of first, second, and third electrical wires. A live receptacle is in electrical communication with the end of the first electrical wire. A neutral receptacle is in electrical communication with the end of the second electrical wire. A ground receptacle is in electrical communication with the end of the third electrical wire. The body portion surrounds and maintains the live, neutral, and ground receptacles in spaced apart orientation corresponding to blades on an electrical plug. Multiple indicator lights are provided to indicate various states of the plug in which electricity is supplied to the plug.

15 Claims, 9 Drawing Sheets

(56) References Cited

U.S. PATENT DOCUMENTS 3,495,205 A * 2/1970 Ricci ..... H01R 27/00 439/103
3,531,757 A 9/1970 Alden
3,688,244 A 8/1972 Savoca et al.
3,733,576 A 5/1973 Cooper
3,739,317 A * 6/1973 Wise ..... H01R 27/00 439/103
3,753,261 A 8/1973 Thaxton
3,754,202 A 8/1973 Nelson
3,786,392 A 1/1974 McDaniel
3,890,030 A 6/1975 McDaniel
3,924,914 A 12/1975 Banner
3,958,849 A 5/1976 Blairsdale
4,015,888 A 4/1977 Draper et al.
4,078,848 A 3/1978 Blairsdale
4,081,206 A 3/1978 Lee
4,111,516 A 9/1978 Wireman
4,113,333 A 9/1978 Horowitz
4,118,690 A 10/1978 Paynton
4,201,431 A 5/1980 McDonald
4,388,604 A 6/1983 Ahroni
4,671,597 A 6/1987 Grill
4,768,979 A 9/1988 Wu
4,878,852 A 11/1989 Bertsch et al.
4,904,976 A 2/1990 Liaq
4,954,091 A 9/1990 Marble et al.
5,116,232 A 5/1992 Follett
5,159,545 A 10/1992 Lee
5,207,594 A * 5/1993 Olson ..... H01R 13/652 340/656
5,306,164 A 4/1994 Hollander et al.
5,470,252 A 11/1995 Fladung
5,567,175 A 10/1996 Warden et al.
5,622,509 A 4/1997 Smythe et al.
5,641,292 A 6/1997 Fann
5,644,462 A 7/1997 Boschetto et al.
5,791,921 A 8/1998 Lee
6,053,750 A 4/2000 Waible
6,247,941 B1 6/2001 Lee et al.
6,267,627 B1 7/2001 Lin
6,287,131 B1 9/2001 Deng
6,419,504 B1 7/2002 Nelson
6,802,741 B1 10/2004 Shatkin
6,827,602 B2 * 12/2004 Greene ..... H01R 13/465 439/488
7,052,298 B1 5/2006 Cheng
7,086,892 B2 8/2006 Tanacan
7,114,979 B1 10/2006 Lai
7,160,124 B2 1/2007 Bhutani
7,513,782 B1 4/2009 Sheldon et al.
7,575,438 B2 8/2009 Dilgard
7,824,195 B1 11/2010 Yu et al.
8,062,059 B2 11/2011 Roneker
8,317,527 B2 11/2012 Vitale
8,342,862 B2 1/2013 Konersmann et al.
8,936,490 B2 1/2015 Hsu
9,716,352 B1 * 7/2017 Gilliland ..... H01R 24/30
9,941,638 B2 * 4/2018 Gilliland ..... H01R 13/641
10,297,959 B2 * 5/2019 Gilliland ..... H01R 13/641
2004/0029435 A1 2/2004 Larson
2008/0080183 A1 4/2008 Tseng
2009/0061668 A1 3/2009 Powell et al.
2010/0255729 A1 10/2010 Su
2010/0317222 A1 12/2010 Tom et al.
2011/0230081 A1 * 9/2011 Rinehardt ..... H01R 11/24 439/490
2011/0269352 A1 11/2011 Vitale
2012/0064758 A1 3/2012 Grice et al.
2012/0113573 A1 * 5/2012 Ko ..... H01R 13/641 361/679.01
2012/0122327 A1 5/2012 Konersmann et al.
2014/0080353 A1 3/2014 Ku
2014/0080354 A1 * 3/2014 Caveney ..... H04Q 1/136 439/490
2014/0187078 A1 7/2014 Zhou
2014/0377982 A1 12/2014 Smith
2016/0020556 A1 1/2016 Soos

* cited by examiner

ELECTRICAL CORD HAVING PLUGS MULTI-FUNCTIONAL LIGHT INDICATORS

CROSS-REFERENCE TO RELATED APPLICATIONS

This application is a continuation-in-part of U.S. patent application Ser. No. 15/723,965, filed on Oct. 3, 2017, which is a continuation-in-part of U.S. patent application Ser. No. 15/412,336, filed on Jan. 23, 2017, now U.S. Pat. No. 9,941,638, which was a continuation-in-part of U.S. patent application Ser. No. 15/152,076, filed on May 11, 2016, now U.S. Pat. No. 9,716,352, which claimed the benefit of U.S. Provisional Patent Application Ser. No. 62/281,467, filed on Jan. 21, 2016, and U.S. Provisional Patent Application Ser. No. 62/318,492, filed on Apr. 5, 2016, the contents of which are incorporated herein in their entirety by reference.

STATEMENT REGARDING FEDERALLY-SPONSORED RESEARCH OR DEVELOPMENT

Not Applicable

BACKGROUND OF THE INVENTION

1. Field of Invention

The present general inventive concept relates to electrical cords, and, more particularly, to an electrical cord having plugs with improved safety features, such as for example a structurally reinforced ground pin and/or one or more indicator lights indicating various states of electrical activity of the cord.

2. Description of the Related Art

In the United States, standard electrical plugs for an electrical power cord have either two or three pins which are configured to be received by corresponding sockets of an electrical outlet to establish an electrical current path to provide electrical current to power an electronic load device. In a two-pin plug, one pin is live and carries current from the source to the load device. The other pin is neutral and returns the current from the load device to the source. A three-pin plug is similar to a two-pin plug in that it includes a live pin, or "blade," and a neutral blade. However, a three-prong plug also includes a ground pin, the purpose of which is to connect the load device to a grounded electrical path. Thus, the ground pin serves to protect the load device against electric shock due, for example, to insulation failure. The ground pin, when connected to a grounded path, also limits the build-up of static electricity on parts of the device.

A three-pin plug may provide many advantages over a two-pin plug. However, in order to properly utilize a three-pin plug, an electrical outlet having three sockets corresponding to the three pins of the three-pin plug is required. Often, it is necessary or desirable to plug a three-pin plug into an electrical outlet having only two sockets, of the type specifically designed for use with a two-pin plug. In such situations, many users of electrical devices may use a so-called "ground lifting plug," which is an electrical plug adapter that essentially consists of a three-socket receptacle on one side, and a two-pin plug on the other side. However, it is also not uncommon for a user to simply bend, break off, or otherwise remove, a ground pin from a three-pin plug in order to allow the remaining two pins to fit into a two-socket receptacle of an outlet.

In several situations, such as for example in commercial settings and/or on construction sites, the practice of damaging or removing a ground pin from a three-pin plug and then subsequently using the plug is prohibited by various rules, ordinances, or laws. For example, in a construction setting, use of an extension cord or other power cord having a missing or damaged ground pin is prohibited by the rules of the Occupational Safety and Health Administration ("OSHA"). Accordingly, if a worker on a construction site damages or removes a ground pin on an extension cord having a three-pin plug, it becomes necessary to replace or repair the pin, or to replace the extension cord, often at significant burden and expense. Additionally, construction sites, businesses, and the like are often subjected to various administrative and governmental inspections in which, among other things, electrical plugs and/or cords may be inspected to ensure the plug includes a properly functioning ground pin and that the cord is capable of being properly grounded. Such inspections are often time consuming and can result in costly and burdensome delays to the normal operations of the construction site or business.

Additional disadvantages are associated with the use of power cords having damaged or removed ground pins. For example, many electronic load devices, such as various types of power tools, medical devices, household electronic devices, etc., are designed to operate with the current powering the device running in a specific "polarity," that is, in a specific direction along the power circuit. More specifically, these devices are typically designed to operate with current running from the live wire of the power cord, through the device, to the neutral wire. In many such devices, exposing the device to "reversed polarity," that is, current flowing backward along the intended circuit path; i.e., from the neutral wire of the power cord, backward through the device, to the live wire; can result in improper function and/or damage to the device. Thus, when an extension cord is used to connect such devices to an outlet of an electrical source, it is important to ensure that the extension cord is connected to the electrical source in the proper polarity. In other words, it is important that the live blade of the extension cord plug is received within the live socket of the electrical outlet and the neutral blade of the extension cord plug is received within the neutral socket of the electrical outlet.

In the case of the above-discussed extension cords employing three-pin plugs, one additional function of the ground pin is to ensure that the extension cord is plugged into an electrical outlet in the proper polarity. With the ground pin of the three-pin plug of the extension cord intact, the three-pin plug will only fit into the sockets of the electrical outlet in one orientation, that is, with the extension cord plug in the proper polarity. However, when the ground pin of the three-pin plug is damaged or removed, it is possible for the orientation of the plug to be inverted, such that the live blade of the extension cord plug is received within the neutral socket of the electrical outlet and the neutral blade of the extension cord plug is received within the live socket of the electrical outlet. In this orientation, the polarity of the extension cord is reversed, and if an electronic load device is then plugged into the reversed polarity extension cord, it is possible that the electronic load device may be exposed to reversed polarity current.

Additional circumstances can arise in which an electronic load device may be inadvertently exposed to reversed polarity current. For example, if an electrical outlet is incorrectly wired in such a manner that the outlet itself receives reversed polarity current, that is, if the outlet is wired such that the neutral socket of the electrical outlet is in electrical communication with a live wire of a current source and the live socket of the electrical outlet is in electrical communication with a neutral wire of the current source, an extension cord which is plugged into the outlet in a proper orientation may nonetheless be subjected to reversed polarity current. Likewise, an electrical panel, circuit breaker receptacle, or other such device configured to supply electrical current to the outlet may be improperly wired to allow reversed polarity current to the outlet. Thus, in the use of extension cords and other power cords, there is a risk associated with subjecting an electronic load device to reversed polarity current.

In light of the above, there is a need for an electrical cord incorporating a three-pin plug having an improved ground pin, in which the ground pin is easily replaced, and in which the ground pin is constructed to exhibit improved strength over prior art devices, such that the ground pin is difficult to damage or break. There is a further need for an electrical cord incorporating a three-pin plug having an improved ground pin, in which the plug provides a readily-identifiable signal indicating a condition of the plug in which the ground pin may have become damaged or broken, or in which the cord is not capable of being properly grounded. There is a further need for an electrical cord in which the plug provides a readily-identifiable signal indicating a condition of the electrical cord in which the polarity of current supplied to the cord is reversed.

BRIEF SUMMARY OF THE INVENTION

The present general inventive concept, in various example embodiments, includes an electrical cord having one or more plugs with improved safety features. Various example embodiments of the present general inventive concept may be achieved by providing a cable having a first electrical wire configured to carry current to a load device, a second electrical wire configured to return current from the load device, and a third electrical wire configured to carry current to a ground connection. A first plug may be provided comprising a first body portion surrounding respective first ends of the first, second, and third electrical wires. A live blade may be provided in electrical communication with the first end of the first electrical wire. A neutral blade may be provided in electrical communication with the first end of the second electrical wire. A ground pin receptacle may be provided in electrical communication with the first end of the third electrical wire. A ground pin may be secured within the ground pin receptacle to place the ground pin receptacle and third electrical wire in electrical communication with the ground pin. The first body portion may surround and maintain the live blade, neutral blade, and ground pin receptacle in spaced apart orientation corresponding to sockets on an electrical outlet.

Additional example embodiments of the present general inventive concept may be achieved in which the ground pin receptacle defines an internally threaded surface and the ground pin defines an externally threaded surface configured for threaded, mating engagement with the internally threaded surface, and wherein the internally and externally threaded surfaces define a non-standard thread pattern. In additional embodiments, the internally and externally threaded surfaces may each define a left-hand thread orientation. In various embodiments, the ground pin receptacle may be defined by a ground pin clip having a forward portion defining an internally threaded through bore and a rearward portion defining a clamp for establishing mechanical and electrical engagement of the ground pin clip with the third electrical wire. In various embodiments, the ground pin clip may have a central portion configured to provide reinforcing support for the ground pin to limit deformation or detachment of the ground pin from the ground pin receptacle. In various embodiments, the ground pin clip central portion may define a C-shape and a bearing surface disposed rearward of the internally threaded through bore, in axial alignment therewith. The ground pin clip may be configured such that the ground pin abuts the bearing surface when the ground pin is fully threadably received within the internally threaded through bore. Thus, the C-shape of the central portion may encourage rotational moment forces acting on the ground pin to exert force in a direction perpendicular to the bearing surface, thereby limiting deformation of the ground pin receptacle.

Additional example embodiments of the present general inventive concept may be achieved in which the first body portion may be fabricated of an at-least translucent material and may carry a first indicator light therein. The first indicator light may be configured to indicate a grounded state of the electrical cord. For example, in various embodiments, the first indicator light may be in electrical communication with the live blade and the ground pin receptacle. Various example embodiments of the present general inventive concept may be achieved by providing a first resistor electrically connected in series between the live blade and the first indicator light, the first resistor configured to limit the flow of electricity between the live blade and the first indicator light.

Additional example embodiments of the present general inventive concept may be achieved by providing a second plug comprising a second body portion surrounding respective second ends of the first, second, and third electrical wires. A live receptacle may be provided in electrical communication with the second end of the first electrical wire. A neutral receptacle may be provided in electrical communication with the second end of the second electrical wire. A ground receptacle may be provided in electrical communication with the second end of the third electrical wire. The second body portion may surround and maintain the live receptacle, neutral receptacle, and ground receptacle in spaced apart orientation corresponding to pins on an electrical plug. In various embodiments, the second body portion may be fabricated of an at-least translucent material and carrying a second indicator light therein. The second indicator light may be configured to indicate a state in which electricity is supplied to the electrical cord. The second indicator light may be in electrical communication with the second end of the first electrical wire and the second end of the third electrical wire. A second resistor may be electrically connected in series between the second end of the first electrical wire and the second indicator light, the second resistor configured to limit the flow of electricity between the second end of the first electrical wire and the second indicator light.

Additional example embodiments of the present general inventive concept may be achieved by providing a plug for an electrical power cord. In various embodiments, the plug may comprise a body portion defining a front face. A live blade may be provided having a proximal end received within the body portion and a distal end protruding from the front face. The proximal end of the live blade may define a first clamp adapted to mechanically and electrically engage a first electrical wire to establish electrical communication between the first electrical wire and the live blade distal end. A neutral blade may be provided having a proximal end received within the body portion and a distal end protruding from the front face. The proximal end of the neutral blade may define a second clamp adapted to mechanically and electrically engage a second electrical wire to establish electrical communication between the second electrical wire and the neutral blade distal end. A ground pin clip may be received within the body portion. The ground pin clip may have a proximal end defining a third clamp adapted to mechanically and electrically engage a third electrical wire to establish electrical communication between the third electrical wire and the ground pin clip. The ground pin clip may have a distal end defining a ground pin receptacle opening to the front face of the body portion. A ground pin may be secured within the ground pin receptacle to place the ground pin in electrical communication with the third electrical wire. The body portion may maintain the live blade, neutral blade, and ground pin receptacle in a spaced apart orientation along the front face corresponding to sockets on an electrical outlet.

In various embodiments, the ground pin clip may have a central portion configured to provide reinforcing support for the ground pin to limit deformation or detachment of the ground pin from the ground pin receptacle. In various embodiments, the ground pin clip central portion may define a bearing surface adjacent the third clamp and a C-shaped portion between the bearing surface and the ground pin receptacle. The ground pin clip may be configured such that the ground pin abuts the bearing surface when the ground pin is fully received within the ground pin receptacle. Thus, the C-shape of the central portion may encourage rotational moment forces acting on the ground pin to exert force in a direction perpendicular to the bearing surface, thereby limiting deformation of the ground pin receptacle. In various embodiments, the body portion may be fabricated of an at-least translucent material and may carry an indicator light therein. The indicator light may be configured to indicate a grounded state of the plug. In various embodiments, the indicator light may be in electrical communication with the live blade and the ground pin clip. In various embodiments, a resistor may be provided electrically connected in series between the live blade and the first indicator light. The resistor may be configured to limit the flow of electricity between the live blade and the indicator light.

Additional example embodiments of the present general inventive concept may be achieved by providing an electrical cord having improved safety features, the electrical cord comprising a cable having a first electrical wire configured to carry current to a load device, a second electrical wire configured to return current from the load device, and a third electrical wire configured to carry current to a ground connection. The electrical cord may also comprise a first plug comprising a first body portion surrounding respective first ends of the first, second, and third electrical wires; a live blade in electrical communication with the first end of the first electrical wire; a neutral blade in electrical communication with the first end of the second electrical wire; and a ground pin in electrical communication with the first end of the third electrical wire. The first body portion may surround and maintain the live blade, neutral blade, and ground pin in spaced apart orientation corresponding to sockets on an electrical outlet. The electrical cord may further comprise a second plug comprising a second body portion fabricated of an at-least translucent material and surrounding respective second ends of the first, second, and third electrical wires; a live receptacle in electrical communication with the second end of the first electrical wire; a neutral receptacle in electrical communication with the second end of the second electrical wire; and a ground receptacle in electrical communication with the second end of the third electrical wire. The electrical cord may further comprise an indicator configured to provide a first signal to indicate a first state of the electrical cord in which electricity is supplied to the electrical cord in a normal polarity, from the first electrical wire to the second electrical wire, and a second signal to indicate either of a second state of the electrical cord, in which electricity is supplied to the electrical cord in a reversed polarity, from the second electrical wire to the first electrical wire, and a third state of the electrical cord, in which electricity is not supplied to the electrical cord. The second body portion may surround and maintain the live receptacle, neutral receptacle, and ground receptacle in spaced apart orientation corresponding to pins on an electrical plug.

Various additional embodiments may be achieved in which the indicator is a first indicator light in electrical communication between the second end of the first electrical wire and the second end of the second electrical wire. Additional embodiments may be achieved in which the second plug further comprises a diode electrically connected in series with the first indicator light between the second end of the first electrical wire and the second end of the second electrical wire, the diode configured to limit the flow of electricity to a normal polarity from the first electrical wire to the second electrical wire, whereby in the first state of the electrical cord, the first indicator light is lit, and whereby in either the second or third states of the electrical cord, the first indicator light is unlit. Additional embodiments may be achieved in which the second plug further comprises a first resistor electrically connected in series with the first indicator light and the diode between the second end of the first electrical wire and the second end of the second electrical wire, the second resistor configured to limit the flow of electricity between the second end of the first electrical wire and the second end of the second electrical wire. Additional embodiments may be achieved in which the first plug further comprises a ground pin receptacle in electrical communication in series between the ground pin and the first end of the third electrical wire, the ground pin receptacle defined by a ground pin clip having a forward portion defining an internally threaded through bore configured to engage an externally threaded surface of the ground pin and a rearward portion defining a clamp for establishing mechanical and electrical engagement of the ground pin clip with the third electrical wire. Additional embodiments may be achieved in which the internally and externally threaded surfaces define a non-standard thread pattern. Additional embodiments may be achieved in which the internally and externally threaded surfaces each define a left-hand thread orientation.

Additional embodiments of the present general inventive concept may be achieved in which the ground pin clip has a central portion configured to provide reinforcing support for the ground pin to limit deformation or detachment of the ground pin from the ground pin receptacle. Additional embodiments may be achieved in which the ground pin clip central portion defines a C-shape and a bearing surface disposed rearward of the internally threaded through bore, in axial alignment therewith, the ground pin clip being configured such that the ground pin abuts the bearing surface when the ground pin is fully threadably received within the internally threaded through bore, whereby the C-shape of the central portion encourages rotational moment forces acting on the ground pin to exert force in a direction perpendicular to the bearing surface, thereby limiting deformation of the ground pin receptacle. Additional embodiments may be achieved in which the first body portion is fabricated of an at-least translucent material and carrying a second indicator light therein, the second indicator light being configured to indicate a grounded state of the electrical cord. Additional embodiments may be achieved in which the second indicator light is in electrical communication with the live blade and the ground pin receptacle. Additional embodiments may be achieved in which the electrical cord further comprises a second resistor electrically connected in series with the second indicator light between the live blade and the ground pin receptacle, the second resistor configured to limit the flow of electricity from the live blade to the ground pin receptacle.

Additional example embodiments of the present general inventive concept may be achieved by providing an electrical cord having improved safety features, the electrical cord comprising a cable having a first electrical wire configured to carry current to a load device, a second electrical wire configured to return current from the load device, and a third electrical wire configured to carry current to a ground connection; and a plug comprising a body portion fabricated of an at-least translucent material and surrounding respective first ends of the first, second, and third electrical wires; a live receptacle in electrical communication with the first end of the first electrical wire; a neutral receptacle in electrical communication with the first end of the second electrical wire; and a ground receptacle in electrical communication with the first end of the third electrical wire. The electrical cord may further comprise an indicator configured to provide a first signal to indicate a first state of the electrical cord in which electricity is supplied to the electrical cord in a polarity from the first electrical wire to the second electrical wire and a second signal to indicate either of a second state of the electrical cord, in which electricity is supplied to the electrical cord in a polarity from the second electrical wire to the first electrical wire, and a third state of the electrical cord, in which electricity is not supplied to the electrical cord. The body portion may surround and maintain the live receptacle, neutral receptacle, and ground receptacle in spaced apart orientation corresponding to pins on an electrical plug.

Additional embodiments of the present general inventive concept may be achieved in which the indicator is a light in electrical communication between the first end of the first electrical wire and the first end of the second electrical wire. Additional embodiments may be achieved in which the plug further comprises a diode electrically connected in series with the light between the second end of the first electrical wire and the second end of the second electrical wire, the diode configured to limit the flow of electricity to a polarity from the first electrical wire to the second electrical wire, whereby in the first state of the electrical cord, the light is lit, and whereby in either the second or third states of the electrical cord, the light is unlit. Additional embodiments may be achieved in which the plug further comprises a resistor electrically connected in series with the light and the diode between the second end of the first electrical wire and the second end of the second electrical wire, the resistor configured to limit the flow of electricity between the second end of the first electrical wire and the second end of the second electrical wire.

Additional example embodiments of the present general inventive concept may be achieved by providing a plug for an electrical power cord, the plug comprising a body portion defining a front face; a live receptacle received within the body portion and opening to the front face, the live receptacle defining a first clamp adapted to mechanically and electrically engage a first electrical wire to establish electrical communication between the first electrical wire and the live receptacle; a neutral receptacle received within the body portion and opening to the front face, the neutral receptacle defining a second clamp adapted to mechanically and electrically engage a second electrical wire to establish electrical communication between the second electrical wire and the neutral receptacle; a ground receptacle received within the body portion and opening to the front face, the ground receptacle defining a third clamp adapted to mechanically and electrically engage a third electrical wire to establish electrical communication between the third electrical wire and the ground receptacle; and an indicator configured to provide a first signal to indicate a first state of the plug in which electricity is supplied to the plug in a polarity from the live receptacle to the neutral receptacle and a second signal to indicate either of a second state of the electrical cord, in which electricity is supplied to the plug in a polarity from the neutral receptacle to the live receptacle, and a third state of the plug, in which electricity is not supplied to the plug. The body portion may maintain the live receptacle, neutral receptacle, and ground receptacle in a spaced apart orientation along the front face corresponding to sockets on an electrical outlet.

Additional embodiments may be achieved in which the indicator is a light in electrical communication between the live receptacle and the neutral receptacle. Additional embodiments may be achieved in which the plug further comprises a diode electrically connected in series with the light between the live receptacle and the neutral receptacle, the diode configured to limit the flow of electricity to a polarity from the live receptacle to the neutral receptacle, whereby in the first state of the plug, the light is lit, and whereby in either the second or third states of the plug, the light is unlit. Additional embodiments may be achieved in which the plug further comprises a resistor electrically connected in series with the light and the diode between the live receptacle and the neutral receptacle, the resistor configured to limit the flow of electricity between the live receptacle and the neutral receptacle.

Additional example embodiments of the present general inventive concept may be achieved by providing a fixed ground pin, in which the ground pin has a permanent solder connection to the ground pin clip and the ground wire has a permanent solder connection to the clamp fitting of the ground pin clip.

Additional aspects and advantages of the present general inventive concept will be set forth in part in the description which follows, and, in part, will be obvious from the description, or may be learned by practice of the present general inventive concept.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTION

Figure 1:
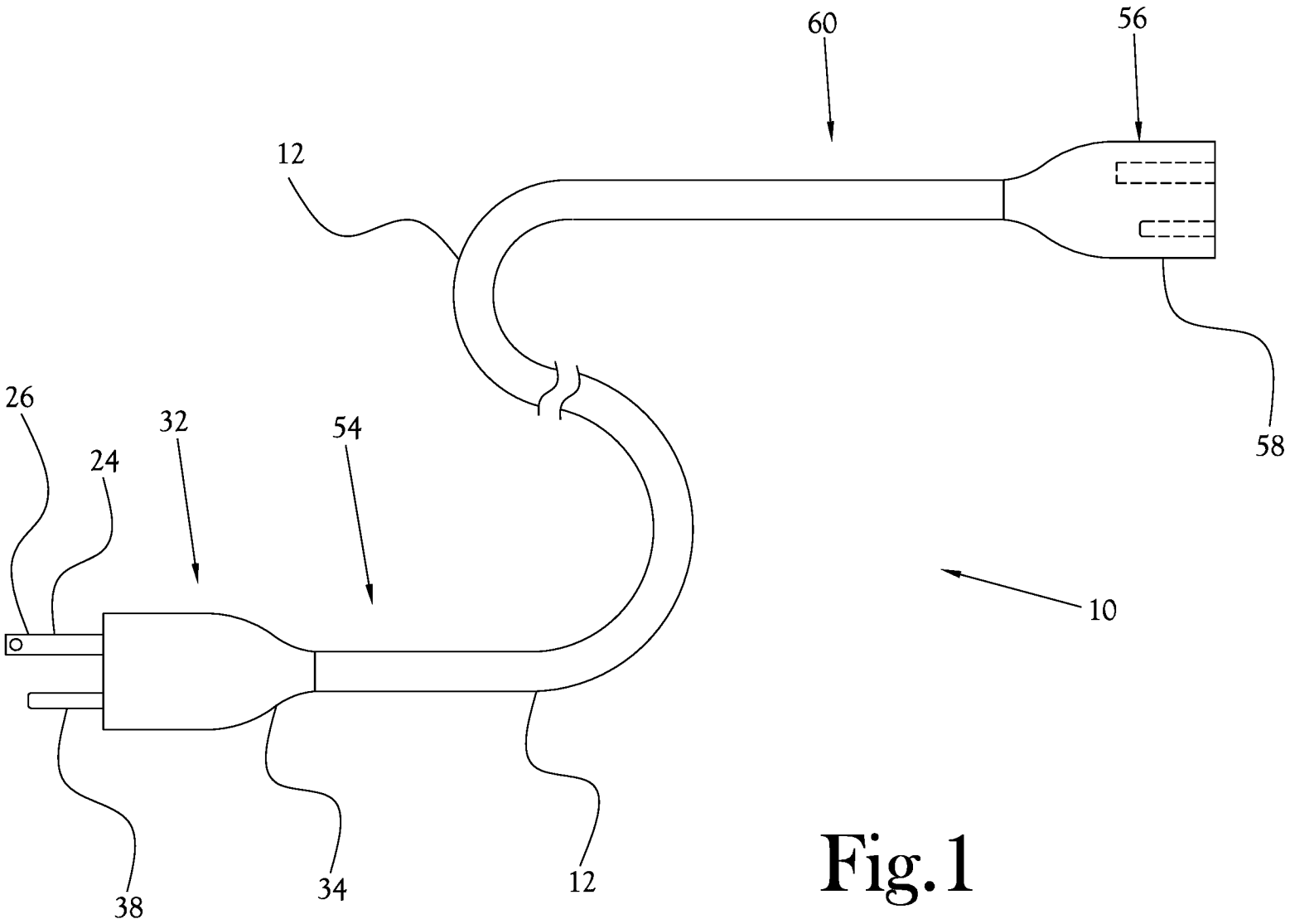
FIG. 1 is a side view showing one embodiment of an electrical cord having plugs with improved safety features constructed in accordance with one example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various examples of the present general inventive concept, an electrical cord having plugs with improved safety features is disclosed. The example embodiments described herein are described with reference to an extension cord, of the type having a three-socket receptacle at one end and a three-pin plug at an opposite end. However, those skilled in the art will recognize that the present general inventive concept may be implemented using any electrical cord having a plug with current-carrying pins. Additionally, it will be recognized that the present general inventive concept is not limited to use on a ground pin, but may be advantageous for use on any suitable pin of an electrical plug.

With reference to FIGS. 1-4, in one embodiment, an electrical cord having plugs with improved safety features 10 is illustrated. The electrical cord having plugs with improved safety features, or "cord," incorporates an electrical cable 12 comprising a live wire 14, a neutral wire 16, and a ground wire 18. In the illustrated embodiment, the electrical cable 12 further comprises three insulative sheathings 20, with one sheathing 20 surrounding each of the live wire 14, the neutral wire 16, and the ground wire 18. An additional exterior sheathing 22 is provided which surrounds all three of the wires 14, 16, 18 and corresponding insulative sheathings 20 to secure the wires in a substantially collinear arrangement, such that a unitary cable 12 is formed.

In various embodiments, a first electrical plug 32 is provided having a body portion 34 which substantially surrounds and encloses a first end 54 of the cable 12 and a front face 36 defining a relatively planar surface sized and shaped to abut and generally conform to a mating electrical outlet. As will be described in further detail below, in this embodiment, the first electrical plug 32 is a "male" type electrical plug having a plurality of pins or "blades" extending from the front face 36 which are adapted to be received by the "female" receptacles of an electrical outlet so as to establish respective electrical connections between each pin of the first electrical plug 32 and a corresponding receptacle of the electrical outlet. More specifically, in the illustrated embodiment, the first electrical plug 32 comprises a live blade 24 and a neutral blade 26, each of an electrically conductive material similar to that of the three wires 14, 16, 18. The live and neutral blades 24, 26 each protrude from within the interior of the electrical plug body portion 34 and extend outwardly through the front face 36 in an orientation such that, when the front face is abutted against the electrical outlet, the live blade 24 fits into a live socket of the electrical outlet, and the neutral blade 26 fits into a neutral socket of the electrical outlet. The live wire 14 is in electrical communication with the live blade 24, and likewise, the neutral wire 16 is in electrical communication with the neutral blade 26. In various embodiments, the live blade 24 is connected to the live wire 14 via an electrically conductive weld, solder, fastener, or the like. Likewise, the neutral blade 26 is connected to the neutral wire 16 via a similar electrically conductive connection. In the illustrated embodiments, the proximal ends of the live and neutral blades 24, 26, within the body portion 34 of the first electrical plug 32, each define a clamp fitting 28 which is configured to receive therein a respective lead end of a corresponding live or neutral wire 14, 16, and thereafter to be crimped to establish both mechanical connection to, and electrical communication with, the received lead end of the corresponding live or neutral wire 14, 16. In various embodiments, each of the connections 28 is of a structurally supportive material, size and shape, such that the live and neutral blades 24, 26 cannot be easily sheared or torn from their respective wires 14, 16.

In various embodiments, a cylindrically-shaped ground pin receptacle 30 is provided within the body portion 34 of the first electrical plug 32. The ground pin receptacle 30 has an internally-threaded surface and opens to the front face 36 of the first electrical plug 32. In various embodiments, a ground pin clip 40 is provided defining the ground pin receptacle 30. In the illustrated embodiment, the ground pin clip 40 has a forward portion 42 extending generally parallel to the front face 36 and defines the ground pin receptacle 30 in the form of an internally-threaded bore extending therethrough. In this embodiment, the front face 36 of the electrical plug body portion 34 defines a through hole 44 therein, and the forward portion 42 of the ground pin clip 40 is disposed along the front face 36 with the ground pin receptacle 30 in underlying relationship with the through hole 44. Thus, the through hole 44 opens to the exterior of the front face 36 of the first electrical plug 32 and to the interior of the ground pin receptacle 30 to define an opening in the front face 36 of the first electrical plug 32 for receipt therein of a ground pin 38, as will be discussed further hereinbelow.

Similarly to the above-discussed live and neutral blades 24, 26, the ground pin clip 40 is fabricated from an electrically conductive material and is in electrical communication with the ground wire 18. For example, in various embodiments, an additional electrically conductive clamp fitting 28 is provided along a rearward portion of the ground pin clip 40. The clamp fitting 28 of the ground pin clip 40 joins the ground pin clip 40 with the ground wire 18, such that the ground pin clip 40 cannot be easily sheared or torn from the ground wire 18.

In the illustrated embodiment, a central portion 46 of the ground pin clip 40 extends from an edge 48 of the forward portion 42 rearward thereof, perpendicular to the front face 36 of the electrical plug body portion 34, and thereafter extends in substantially parallel, underlying relationship with the forward portion 42. Thus, the central portion 46 defines a C-shaped structure rearward of the ground pin receptacle 30 and a bearing surface 50 disposed in co-axial alignment with the ground pin receptacle 30, rearward thereof. The ground pin clip 40 further defines a rearward portion 52 defining the above-discussed clamp fitting 28 for connecting the ground pin clip 40 with the ground wire 18.

In the illustrated embodiment, the body portion 34 of the first electrical plug 32 is formed of a unitary piece of solid material, such as for example polymer plastic, rubber, or the like, and is molded in unity with the various interfaces between the blades 24, 26 and their respective wires 14, 16, and with the interface between the ground pin clip 40 and the ground wire 18. Thus, the body portion 34 substantially surrounds and encloses each of the interfaces between the blades 24, 26 and their respective wires 14, 16. The body portion further surrounds the ground pin receptacle 30 and encloses the interface between the ground pin clip 40 and the ground wire 18. In several preferred embodiments, the body portion 34 is fabricated from a substantially rigid material, such that the body portion 34 assists in maintaining each of the blades 24, 26 and the ground pin clip 40 in a substantially spaced apart relationship from one another and in a rigidly fixed relationship with the ends of the wires 14, 16, 18. As discussed above, leading ends of the blades 24, 26 protrude through the front face 36 of the first electrical plug 32, such that the front face 36 can be positioned against, and flush with, an electrical outlet to allow each of the blades 24, 26 to be received within a corresponding socket of the electrical outlet. The ground pin receptacle 30 is recessed within the body portion 34 and aligns with the through hole 44, such that the internally-threaded internal surface of the ground pin receptacle 30 opens to the front face 36. Thus, when the front face 36 is positioned against an electrical outlet with each of the blades 24, 26 received within a corresponding socket of the electrical outlet, the internally-threaded internal cylindrical surface of the ground pin receptacle 30 is positioned in a coaxial relationship with a ground socket of the electrical outlet.

As discussed above, a ground pin 38 is provided, comprising a substantially straight, elongated segment of electrically conductive material. A first end of the ground pin 38 defines an externally threaded cylindrical surface, the threads of which are sized and shaped to allow the ground pin first end to be threadably received within and mated to the interior of the ground pin receptacle 30. In this configuration, the remainder of the ground pin 38 protrudes outwardly from the front face 36, such that when the front face 36 is positioned against an electrical outlet with each of the blades 24, 26 received within a corresponding socket of the electrical outlet, the ground pin 38 is received within the ground socket of the electrical outlet, such that the ground pin 38 establishes electrical communication with the ground socket. In a preferred embodiment, the ground pin 38 is of a substantially rigid and structurally reinforced fabrication, such that bending or breaking of the ground pin 38 is discouraged. For example, in one embodiment, the ground pin 38 is fabricated from a solid, cylindrical piece of conductive metal, such as for example bronze, silica bronze, brass, or the like. Additionally, in various embodiments, the external threads of the ground pin 38 are keyed to conform closely with the internal threads of the ground pin receptacle 30, such that the ground pin 38 fits within the ground pin receptacle 30 with very little tolerance. Thus, a "tight fit" is established between the ground pin 38 and the ground pin receptacle 30, such that the threaded engagement of the ground pin 38 by the ground pin receptacle 30 serves to fix and maintain the ground pin 38 in relation to the body portion 34.

In the illustrated embodiment, the externally threaded cylindrical surface extends along the first end of the ground pin 38 a sufficient length to allow the ground pin first end to be threadably received within the ground pin receptacle 30 until the first end of the ground pin 38 abuts the bearing surface 50. In this configuration, the C-shaped central portion 46 of the ground pin clip 40 serves to provide additional structural support to the ground pin 38 in relation to the body portion 34 of the first electrical plug 32. More specifically, as shown in the figures, with the ground pin first end abutted against the bearing surface 50, rotational moment forces acting on the ground pin 38 result in exertion of force by the ground pin 38 either toward or away from the bearing surface 50 of the central portion 46. Thus, in response to rotational moment forces acting on the ground pin 38, the C-shaped central portion 46 exerts responsive force against the body portion 34 of the first electrical plug 32, in which the ground pin clip 40 is encapsulated. Thus, rotation, bending, or other deformity of the ground pin 38 in relation to the body portion 34 of the first electrical plug 32 is discouraged.

In a preferred embodiment, the corresponding threaded surfaces of the ground pin 38 and the ground pin receptacle 30 are shaped and dimensioned such that they do not conform to standard threaded surfaces commonly found in threaded fasteners or the like. For example, in various embodiments, the corresponding threaded surfaces of the ground pin 38 and the ground pin receptacle 30 each define a "left-hand" thread orientation, and in one embodiment, the corresponding threaded surfaces of the ground pin 38 and the ground pin receptacle 30 each define a thread pattern of 23.2 threads-per-inch. In these embodiments, the non-standard thread pattern of the ground pin 38 and the ground pin receptacle 30 serve to discourage threaded receipt of foreign objects, such as screws, bolts, or the like, within the ground pin receptacle 30.

In various embodiments, the body portion 34 of the first electrical plug 32 is fabricated from an at-least translucent, and preferably transparent, material. In various of these embodiments, a first indicator light 70 is provided embedded within the body portion 34 of the first electrical plug 32 and is configured to provide an indication as to an electrical state of the cord 10. For example, in certain embodiments, suitable electrical connections and components are provided such that, in the event the first electrical plug 32 is plugged into a live electrical outlet and the ground wire 18 of the cable 12 is in electrical communication with the ground socket of the electrical outlet, the indicator light will be activated, thereby confirming to a user the grounded condition of the cable. Contrariwise, in the event the first electrical plug 32 is plugged into a live electrical outlet and the first indicator light is not activated, the user is alerted to a non-grounded condition of the cable.

Figure 2:
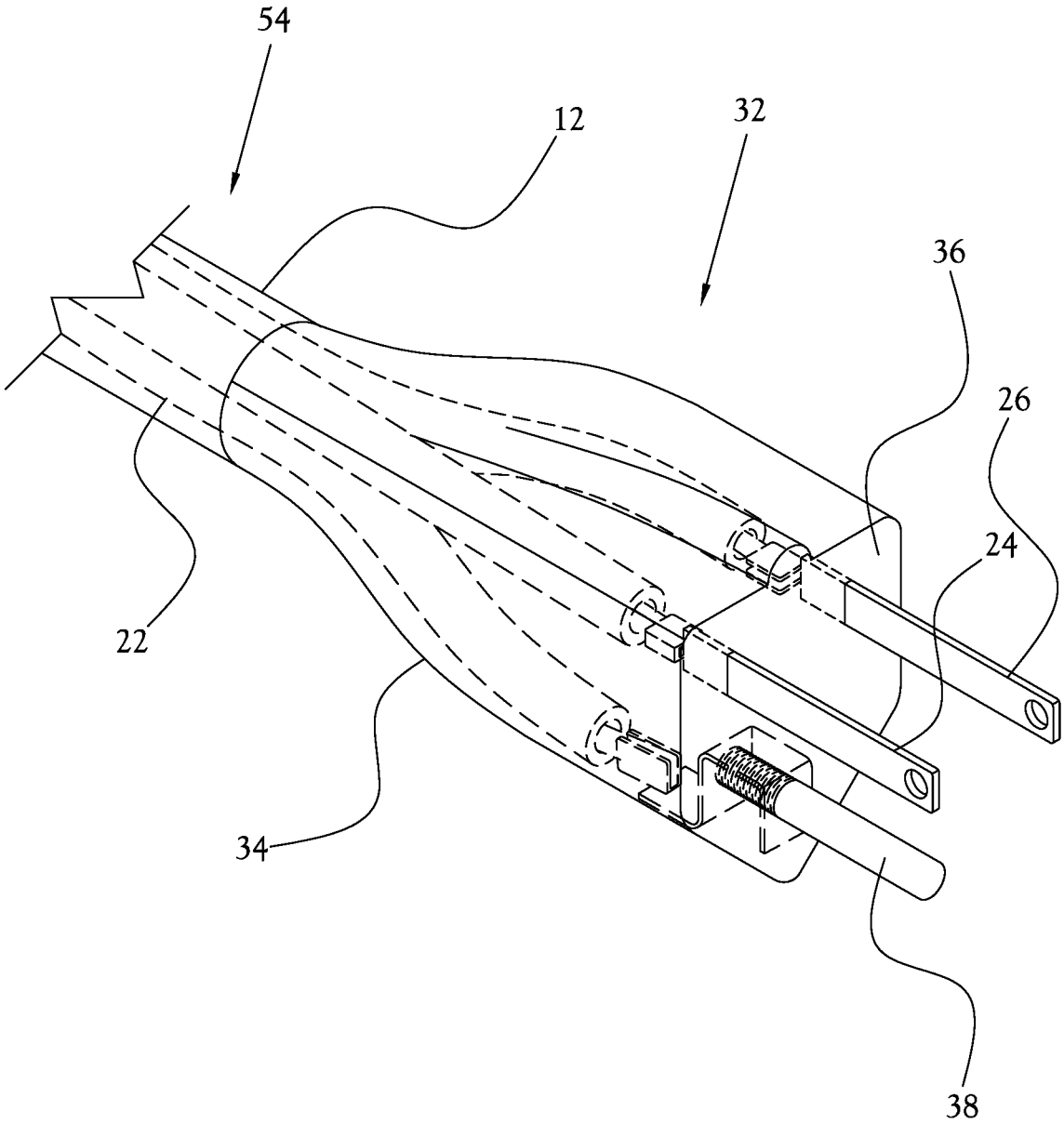
FIG. 2 is a partial perspective view showing the first plug portion of the electrical cord of FIG. 1.
Figure 3:
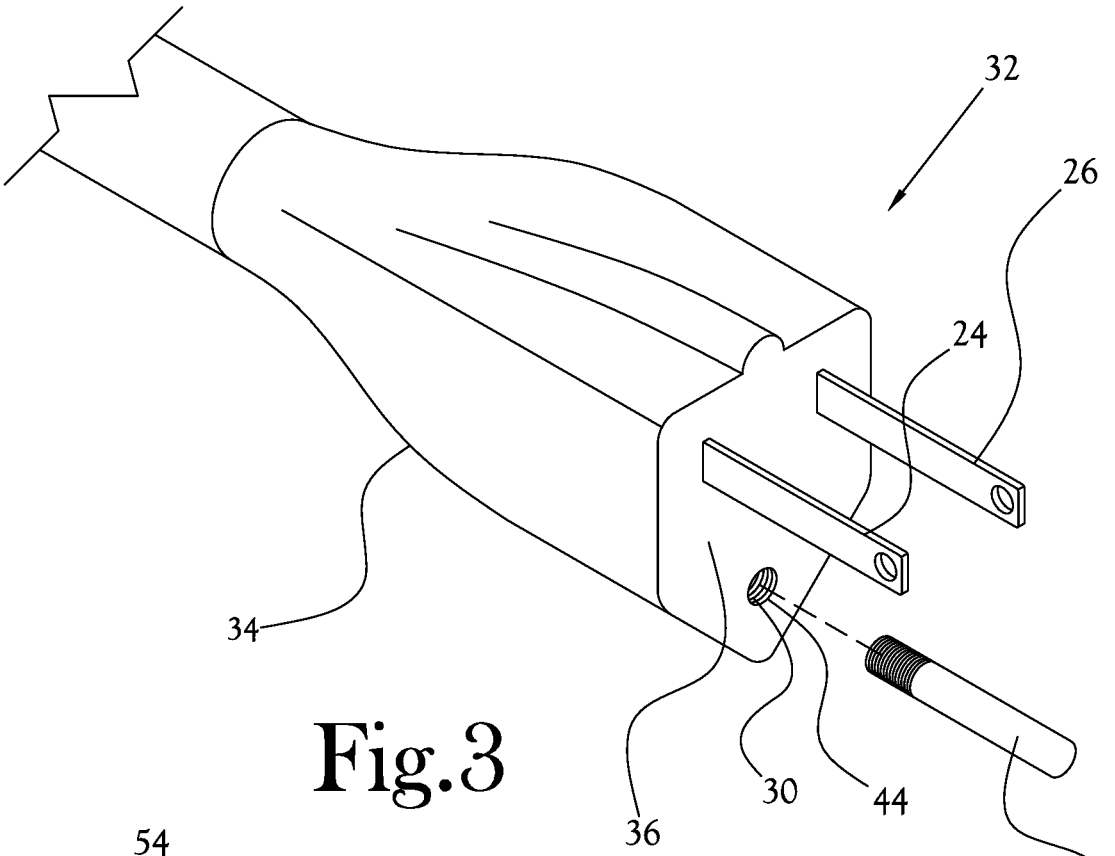
FIG. 3 is a partially exploded partial perspective view showing the first plug portion of the electrical cord of FIG. 2.
Figure 4:
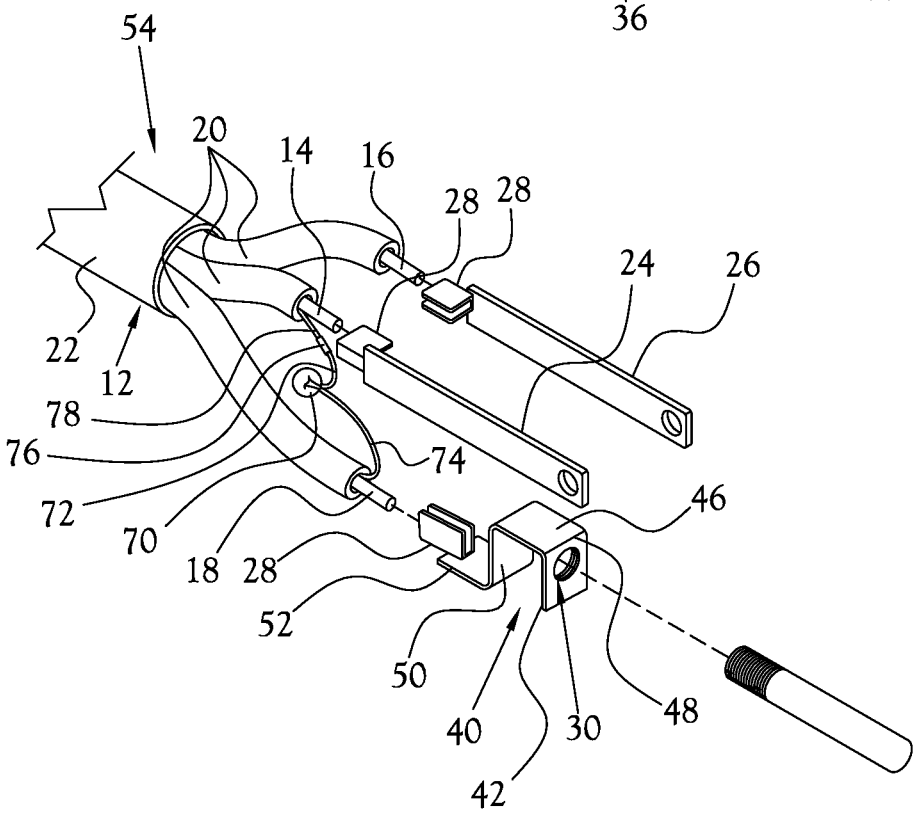
FIG. 4 is an exploded perspective view showing the internal components of the first plug portion of FIG. 3.

With reference to the example embodiment illustrated in FIGS. 2-4, in the illustrated embodiment, the first indicator light 70 defines a first lead 72 and a second lead 74. The first lead 72 is in electrical communication with a resistor 76, which is in turn in electrical communication with the live blade 24. More specifically, in the illustrated embodiment, a lead wire 78 from the resistor 76 is clamped adjacent the lead wire 14 by the clamp fitting 28 of the live blade 24. Thus, the lead wire 78 of the resistor 76 is held in mechanical engagement with, and in electrical communication with, the live blade 24. Likewise, the second lead 74 of the first indicator light 70 is clamped adjacent the ground wire 18 by the clamp fitting 28 of the ground pin clip 40. Thus, the second lead 74 of the first indicator light 70 is held in mechanical engagement with, and in electrical communication with, the ground pin clip 40. In this manner, the resistor 76 and the first indicator light 70 are electrically connected in series between the live blade 24 and the ground pin clip 40. In this configuration, when the first electrical plug 32 is plugged into a live electrical outlet and the ground wire 18 of the cable 12 is in electrical communication with the ground socket of the electrical outlet, a circuit is completed, such that electricity is allowed to flow from the live blade 24, through the lead wire 78, the resistor 76, the first lead 72, the first indicator light 70, the second lead 74, and the ground pin clip 40. The resistor 76 allows only a small amount of electricity therethrough, whereupon the small amount of allowed electricity flows through the first indicator light 70 to activate it, and thereafter through the second lead 74 and along the ground pin clip 40. The activation of the first indicator light 70 serves to indicate a grounded state of the cord 10.

Figure 5:
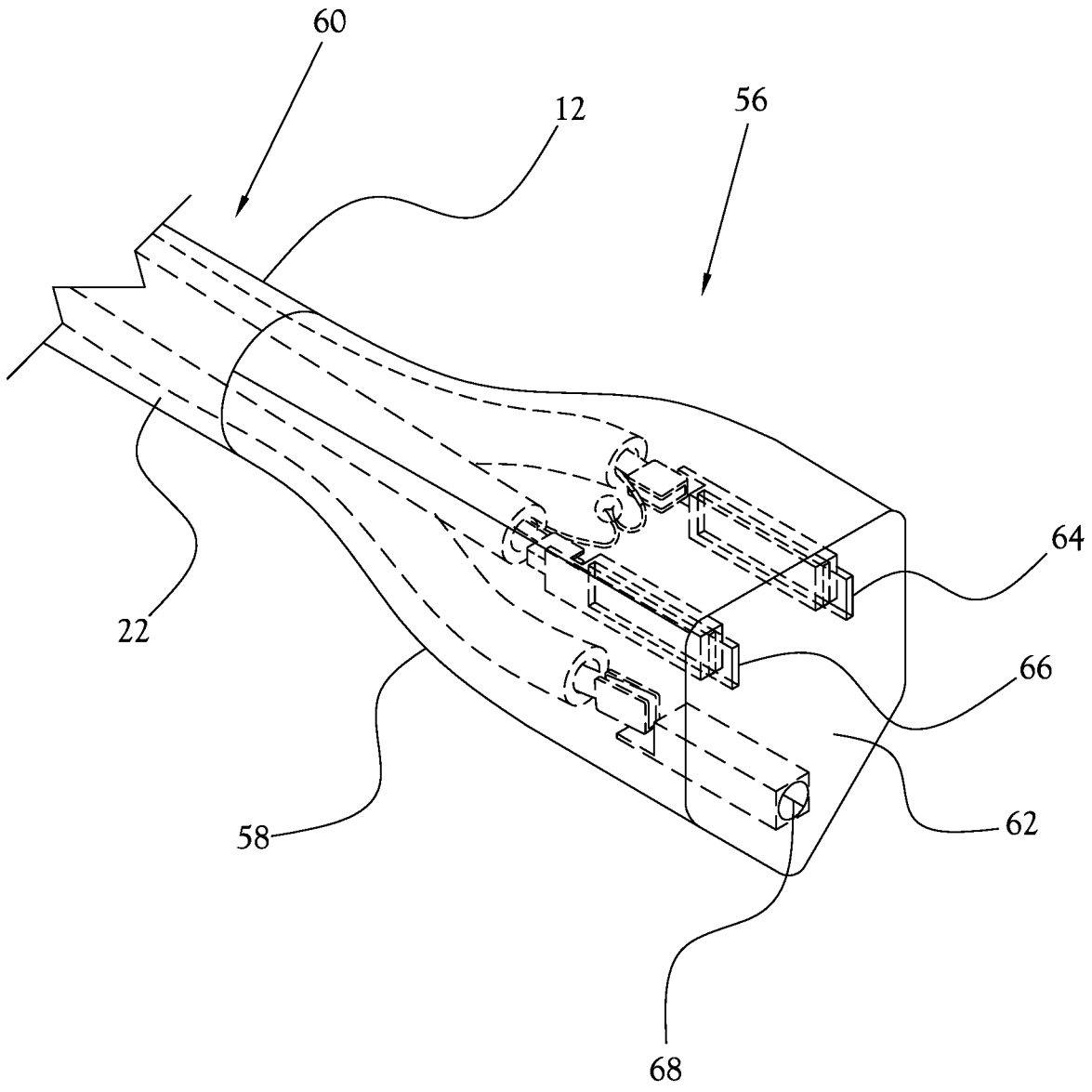
FIG. 5 is a partial perspective view showing the second plug portion of the electrical cord of FIG. 1.
Figure 6:
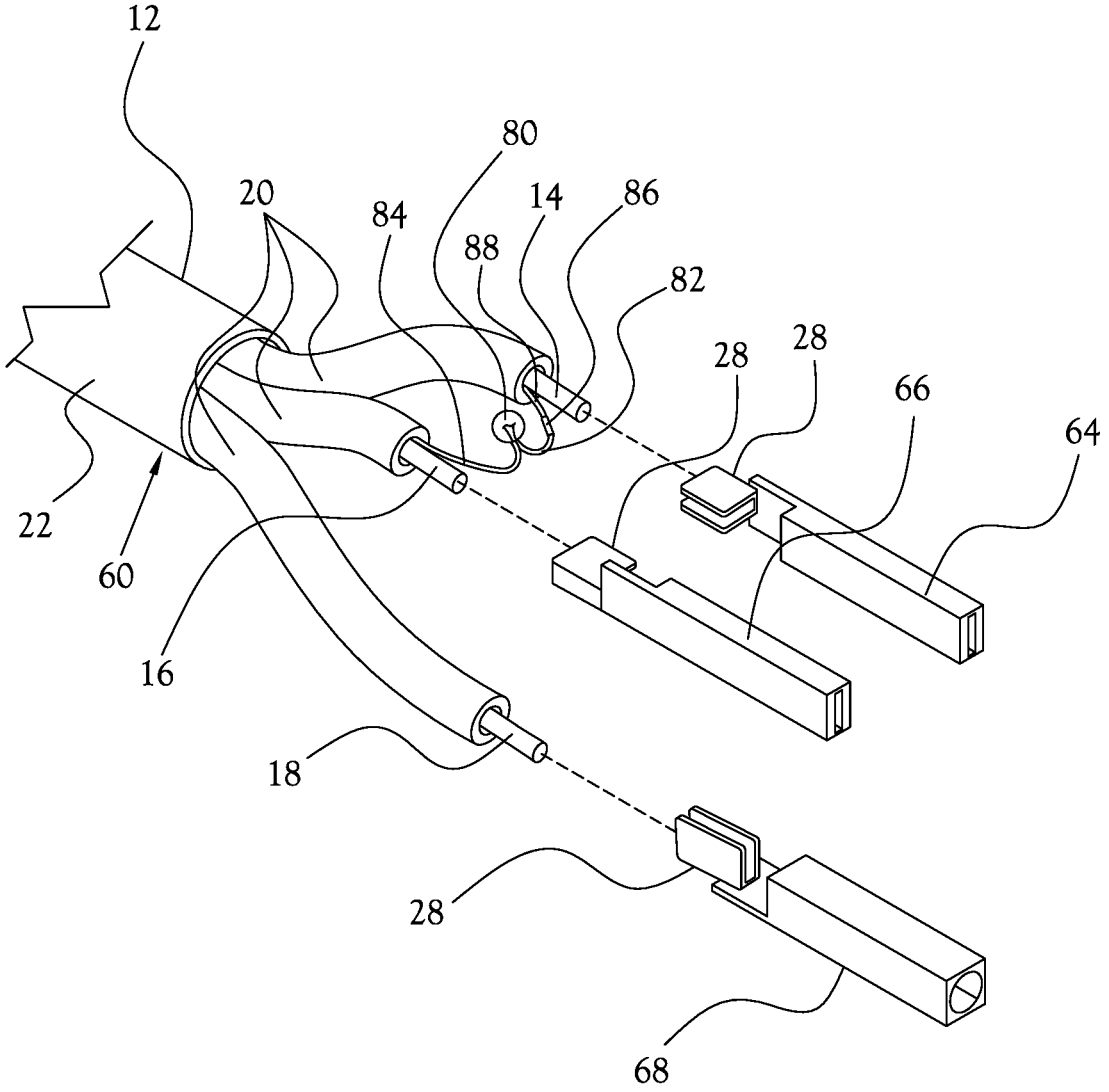
FIG. 6 is an exploded perspective view showing the internal components of the second plug portion of FIG. 5.

With reference now to FIGS. 1, 5, and 6, a second electrical plug 56 is provided having a body portion 58 which substantially surrounds and encloses a second end 60 of the cable 12 and a front face 62 defining a relatively planar surface sized and shaped to abut and generally conform to a mating electrical plug. As will be described in further detail below, in this embodiment, the second electrical plug 56 is a "female" type electrical plug of the type defining a plurality of internally-disposed receptacles opening to the front face 62 which are adapted to be received by corresponding pins or blades of a "male" electrical plug so as to establish electrical connections between each receptacle of the second electrical plug 56 and a corresponding pin of the mated electrical plug. More specifically, in the illustrated embodiment, the second electrical plug 56 comprises a live receptacle 64, a neutral receptacle 66, and a ground receptacle 68, each of an electrically conductive material similar to that of the three wires 14, 16, 18. The live, neutral, and ground receptacles 64, 66, 68 are each received within the interior of the second electrical plug body portion 58 and each defines an open forward end opening to the front face 62 of the body portion 58. The live, neutral, and ground receptacles 64, 66, 68 are oriented along the front face 62 such that, when the front face is mated against an electrical plug, a live blade from the electrical plug fits into the live receptacle 64, a neutral blade from the electrical plug fits into the neutral receptacle 66, and a ground pin from the electrical plug fits into the neutral receptacle 68.

Similarly to the live and neutral blades 24, 26 discussed above, the live wire 14 is in electrical communication with the live receptacle 64. Likewise, the neutral wire 16 is in electrical communication with the neutral receptacle 66, and the ground wire 18 is in electrical communication with the ground receptacle 68. More specifically, in the illustrated embodiment, the proximal ends of the live, neutral, and ground receptacles 64, 66, 68 within the body portion 58 of the second electrical plug 56 each define a clamp fitting 28 which is configured to receive therein a respective lead end of a corresponding live, neutral, or ground wire 14, 16, 18, and thereafter to be crimped to establish both mechanical connection to, and electrical communication with, the received lead end of the corresponding live, neutral, or ground wire 14, 16, 18. It will be recognized that, in other embodiments, the live, neutral, and ground receptacles 64, 66, 68 may be connected to the respective live, neutral, or ground wire 14, 16, 18, via an electrically conductive weld, solder, fastener, or the like.

In various embodiments, the body portion 58 of the second electrical plug 56 is also fabricated from an at-least translucent, and preferably transparent, material. In various embodiments, a second indicator light 80 is provided embedded within the body portion 58 of the second electrical plug 56. The second indicator light 80 is configured to provide an indication as to another electrical state of the cord 10. For example, in certain embodiments, suitable electrical connections and components are provided such that, in the event the first electrical plug 32 is plugged into a live electrical outlet, the second indicator light 80 will be activated, thereby confirming to a user that the cord 10 is in a "ready" state, that is, capable of supplying electricity. Contrariwise, in the event the second indicator light 80 is not activated, the user is alerted that the cord 10 is not in a "ready" state, such as for example may exist when the first electrical plug 32 is not plugged into a live electrical outlet.

With reference to the example embodiment illustrated in FIGS. 5 and 6, in the illustrated embodiment, the second indicator light 80 defines a first lead 82 and a second lead 84. Similarly to the configuration of the first indicator light described above, the first lead 82 is in electrical communication with a resistor 86, which is in turn in electrical communication with the live wire 14. More specifically, in the illustrated embodiment, a lead wire 88 from the resistor 86 is clamped adjacent the lead wire 14 by the clamp fitting 28 of the live receptacle 64. Thus, the lead wire 88 of the resistor 86 is held in mechanical engagement with, and in electrical communication with, the live wire 14. However, unlike the configuration of the first indicator light, the second lead 84 of the second indicator light 80 is clamped adjacent the neutral wire 16 by the clamp fitting 28 of the neutral receptacle 66. Thus, the second lead 84 of the second indicator light 80 is held in mechanical engagement with, and in electrical communication with, the neutral wire 16. In this manner, the resistor 86 and the second indicator light 80 are electrically connected in series between the live wire 14 and the neutral wire 16. In this configuration, when the first electrical plug 32 is plugged into a live electrical outlet, a circuit is completed, such that electricity is allowed to flow from the live wire 14, through the lead wire 88, the resistor 86, the first lead 82, the second indicator light 80, the second lead 84, and the neutral wire 16. The resistor 86 allows only a small amount of electricity therethrough, whereupon the small amount of allowed electricity flows through the second indicator light 80 to activate it, and thereafter through the second lead 84 and along the neutral wire 16. The activation of the second indicator light 80 serves to indicate a powered state of the cord 10.

It will be recognized that additional features of the cord 10 may be provided without departing from the spirit and scope of the present general inventive concept. For example, in certain more discreet embodiments, the body portion 34 of the first electrical plug 32 defines a small compartment, recess, or the like, for receiving therein and storing the ground pin 38, or one or more replacement ground pins. Thus, in these embodiments, upon removal of the ground pin 38 from the ground pin receptacle 30, the ground pin 38 may be received and stored within the compartment for subsequent removal and reinsertion into the ground pin receptacle 30. In one embodiment, the compartment is a cylindrical cavity having one end opening to an exterior of the body portion 34 and is sized and shaped to receive therein and conform to the ground pin 38, such that when the ground pin 38 is inserted into the cavity, the walls of the cavity frictionally engage the ground pin 38 to retain the ground pin therein. In still other embodiments, an exterior of the body portion 34 defines a textured surface, such that the body portion 34 exhibits non-slip characteristics and is more easily gripped by a user.

Figure 7:
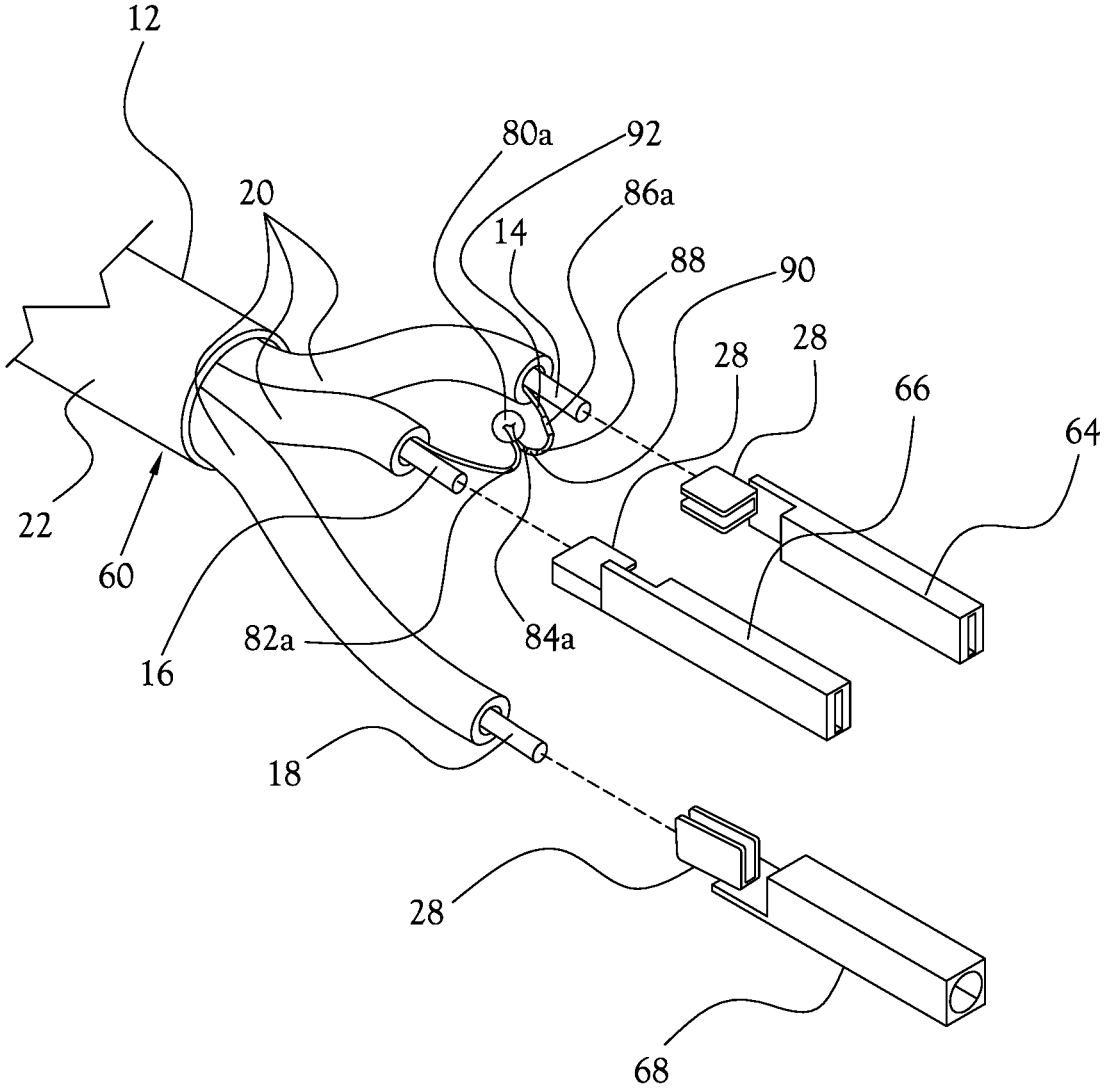
FIG. 7 is an exploded perspective view showing another embodiment of the internal components of the second plug portion.

FIG. 7 illustrates another embodiment of a second electrical plug 56 constructed in accordance with several features of the present general inventive concept. In this and other embodiments, a diode 90 is provided in electrical communication, in series, with the second indicator light 80*a* and the resistor 86*a*, such that the diode 90 limits current flow in a single direction through the resistor 86*a* and second indicator light 80*a*. For example, in the illustrated embodiment of FIG. 7, a second indicator light 80*a* is provided having a first lead 82*a* in electrical communication with the neutral wire 16. The second lead 84*a* of the second indicator light 80*a* is provided in electrical communication with the diode 90, which is in turn in electrical communication with the resistor 86*a*, which is in turn in electrical communication with the live wire 14 by means of an additional lead wire 92 extending from the resistor 86*a* and clamped adjacent the live wire 14 by the clamp fitting 28 of the live receptacle 64. Thus, the lead 92 of the resistor 86*a* is held in mechanical engagement with, and in electrical communication with, the live wire 14. In this manner, the resistor 86*a*, the diode 90, and the second indicator light 80*a* are electrically connected in series between the live wire 14 and the neutral wire 16.

As discussed above, the diode 90 is configured to limit current flow to a single direction through the resistor 86*a* and the second indicator light 80*a*. More specifically, the diode 90 is configured to exhibit low resistance in a direction from the live wire 14 toward the neutral wire 16, and to exhibit high resistance in the opposite direction. Thus, when the first electrical plug 32 is plugged into a live electrical outlet in a proper polarity, that is, with the live blade 24 received within a live receptacle of the electrical outlet and the neutral blade 26 received within a neutral receptacle of the electrical outlet, electricity is allowed to flow from the live wire 14, through the additional lead 92, the resistor 86*a*, the lead wire 88, the diode 90, the second lead 84*a*, the second indicator light 80*a*, the first lead 82*a*, and the neutral wire 16. As discussed above, the resistor 86*a* allows only a small amount of electricity therethrough, whereupon the small amount of allowed electricity flows through the second indicator light 80*a* to activate it, and thereafter through the second lead 84*a* and along the neutral wire 16. In this configuration, the activation of the second indicator light 80*a* serves to indicate a powered state of the cord 10 in which proper polarity is provided. However, if the polarity of the first electrical plug 32 is reversed, such as for example if the first electrical plug 32 is plugged into a live electrical outlet with the live blade 24 received within a neutral receptacle of the electrical outlet and the neutral blade 26 received within a live receptacle of the electrical outlet, or for example if the electrical plug 32 is plugged into the live electrical outlet in a proper orientation but the live electrical outlet is itself supplying reversed polarity current, the diode 90 limits the flow of electricity therethrough, such that the second indicator light 80*a* is not activated. In this configuration, failure to activate the second indicator light 80*a*, notwithstanding the first electrical plug 32 being "plugged in," serves to warn either of a non-powered state of the cord 10 or a powered state of the cord 10 in which polarity is reversed. Thus, a user of the cord 10 may be warned of the potentially hazardous condition of continued use of the cord 10.

Figure 8:
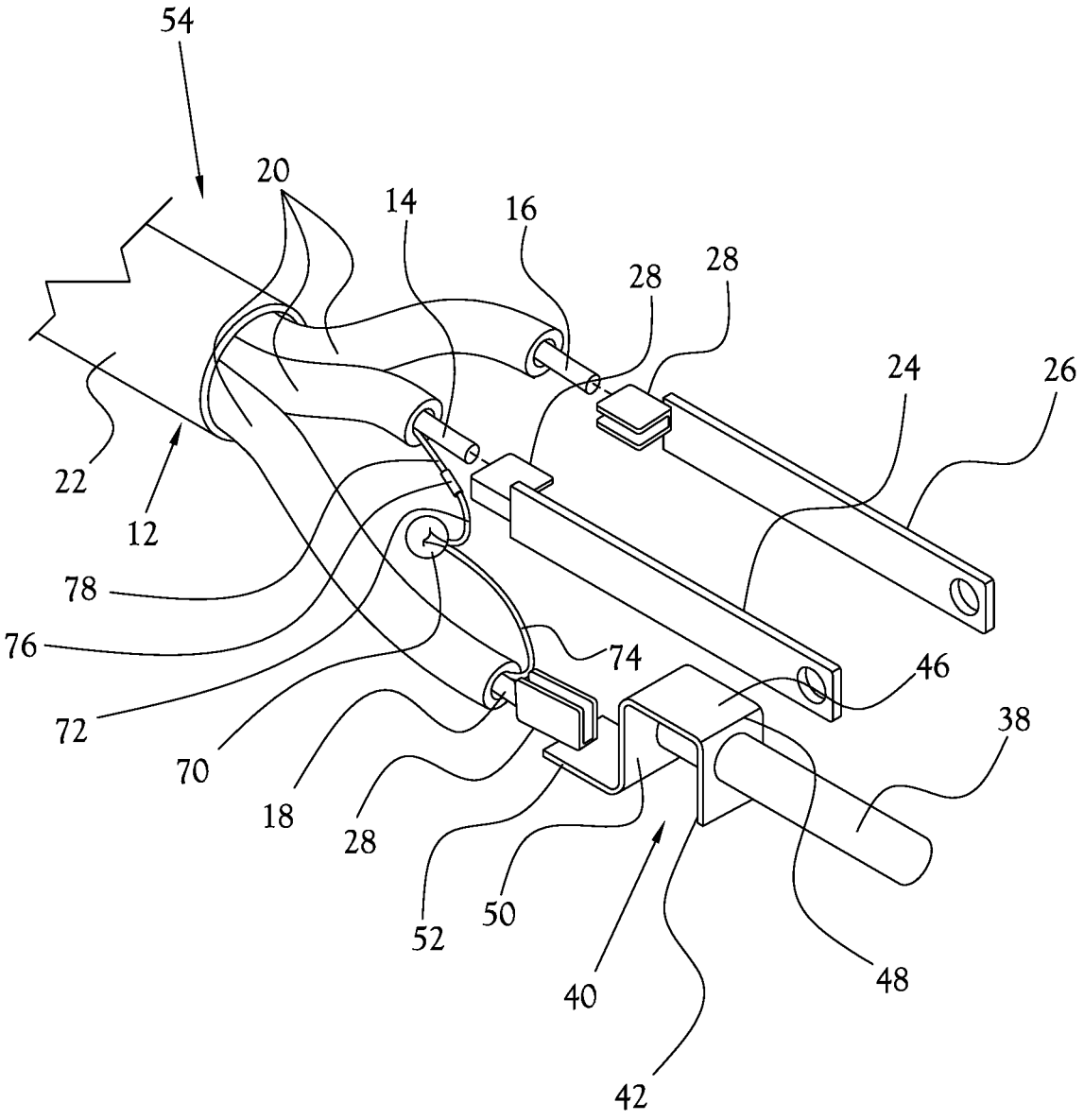
FIG. 8 is an exploded perspective view showing the first plug portion of the electrical cord of FIG. 1 with a fixed ground pin.

FIG. 8 illustrates another embodiment of a first electrical plug 32 constructed in accordance with several features of the present general inventive concept. In this and other embodiments, the ground pin 38 is fixed to the ground pin clip 40 as by a weld, adhesive, integral connection, frictional connection, solder, or the like. In certain embodiments, the ground wire 18 may be fixed to the clamp fitting 28 of the ground pin clip 40, as by, for example, solder. It will be recognized that, in these embodiments, the clamp fitting 28 assists in maintaining a secure anchor of the ground pin 38 within the body portion 34, such that the ground pin 38 is not easily broken or otherwise removed from the body portion 34. At the same time, in this configuration, a serial electrical connection is maintained between the ground wire 18 and the ground pin 38.

Figure 9:
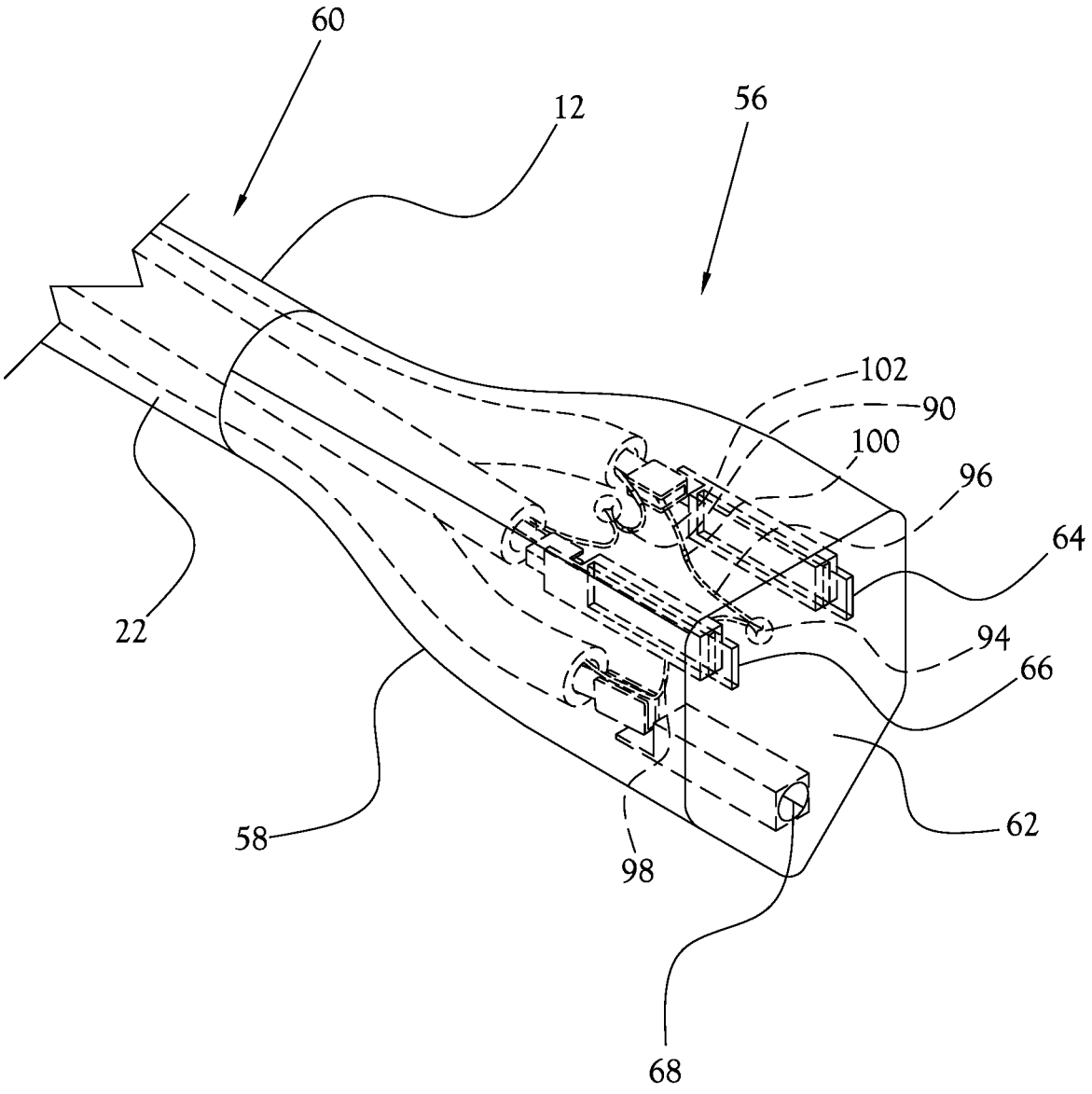
FIG. 9 is a partial perspective view illustrating the second plug portion of the electrical cord of FIG. 1 according to still another embodiment of the present general inventive concept.
Figure 10:
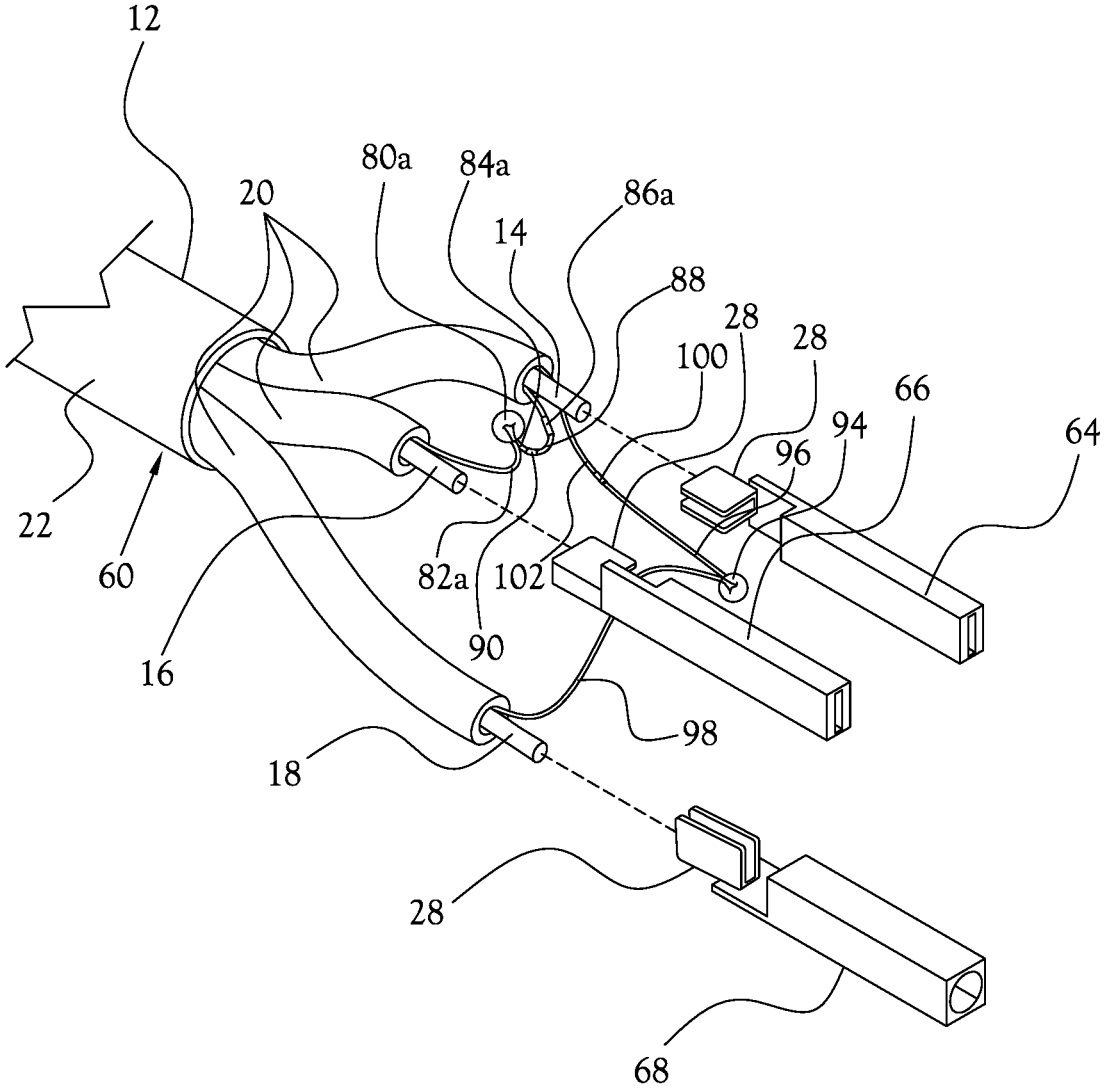
FIG. 10 is an exploded perspective view illustrating the internal components of the second plug portion of FIG. 9.

In the example embodiments described so far, an electrical cord has been described as having an indicator light at one or both ends. However, in various example embodiments of the present general inventive concept an electrical cord may be provided with a plurality of indicator lights, indicating different operating states of the electrical cord, at one or both ends. For instance, an example embodiment of the present general inventive concept may provide a second electrical plug 56 having the polarity indicator configuration illustrated in FIG. 7, including the additional lead 92, the resistor 86*a*, the lead wire 88, the diode 90, the second lead 84*a*, the second indicator light 80*a*, and the first lead 82*a*, along with an additional indicator such as, for example, a ground indicator similar to the first indicator light 70 illustrated in FIG. 4. It is understood that the additional indicator light or lights can be indicative of a host of different conditions of the electrical cord 10. FIG. 9 is a partial perspective view illustrating the second plug portion of the electrical cord of FIG. 1 according to such an example embodiment of the present general inventive concept, and FIG. 10 is an exploded perspective view illustrating the internal components of the second plug portion of FIG. 9. As previously described, the body portion 58 of the second electrical plug 56 may be fabricated from an at-least translucent, and in some examples transparent, material. In various example embodiments, a third indicator light 94 is provided embedded within the body portion 58 of the second electrical plug 56 along with the second light 80*a*, and may be configured to provide another indication as to an electrical state of the cord 10. For instance, in various example embodiments, suitable electrical connections and components are provided such that, in the event the first electrical plug 32 is plugged into a live electrical outlet and the ground wire 18 of the cable 12 is in electrical communication with the ground socket of the electrical outlet, and the resulting properly grounded electrical connection is maintained through to the second electrical plug 56 of the cord 10, then the third indicator light 94 may be activated, thereby confirming to a user the grounded condition of the cable throughout the length of the cord 10. Contrariwise, in the event the first electrical plug 32 is plugged into a live electrical outlet and the third indicator light 94 is not activated, the user is alerted to a non-grounded condition of the cable, at least at the point of the second electrical plug 56.

With reference to the example embodiment illustrated in FIGS. 9-10, in the illustrated embodiment, the third indicator light 94 defines a first lead 96 and a second lead 98. The first lead 96 is in electrical communication with a resistor 100, which is in turn in electrical communication with the live receptacle 64. More specifically, in the illustrated embodiment, a lead wire 102 from the resistor 100 is clamped adjacent the live wire 14 by the clamp fitting 28 of the live receptacle 64. Thus, the lead wire 102 of the resistor 100 is held in mechanical engagement with, and in electrical communication with, the live receptacle 64. Likewise, the second lead 98 of the third indicator light 94 is clamped adjacent the ground wire 18 by the clamp fitting 28 of the ground receptacle 68. Thus, the second lead 98 of the third indicator light 94 is held in mechanical engagement with, and in electrical communication with, the ground receptacle 68. In this manner, the resistor 100 and the third indicator light 94 are electrically connected in series between the live receptacle 64 and the ground receptacle 68. In this configuration, as previously described, when the first electrical plug 32 is plugged into a live electrical outlet and the ground wire 18 of the cable 12 is in electrical communication with the ground socket of the electrical outlet, a circuit is completed such that electricity is allowed to flow from the live blade 24, through the lead wire 78, the resistor 76, the first lead 72, the first indicator light 70, the second lead 74, and the ground pin clip 40. Further, along with those components in the first electrical plug 32, if the wiring is intact through the cable 10 to the second electrical plug 56, then a circuit is also completed such that electricity is allowed to flow from the live blade 24, through the live wire 14, through the lead wire 102, the resistor 100, the first lead 96, the first indicator light 94, the second lead 98, the ground receptacle 68, and the ground wire 18. The resistor 100 allows only a small amount of electricity therethrough, whereupon the small amount of allowed electricity flows through the third indicator light 94 to activate it, and thereafter through the second lead 98 and along the ground receptacle 68 to the ground wire 18. The activation of the third indicator light 94 serves to indicate a grounded state of the cord 10 at the second plug 32. In various example embodiments of the present general inventive concept, the second indicator light 80 may be configured as an amber light to indicate normal polarity at the second plug 32, and the third indicator light 94 may be configured as a green light to indicate that a grounded connection exists from the wall outlet through to the female end, or second plug 32, of the electrical cord 10. In other various example embodiments, different colors or combinations of colors may be used. In various example embodiments, indicia may be provided on the first and/or second plugs to provide more easily discernible state information, either along with or in lieu of the differently colored lights. For example, two indicator lights provided in the second plug 32 may be of the same color, and may be arranged to correspond with indicia provided on the second plug 32 to help a user discern exactly what the lights indicate. It is understood that the "second" and "third" indicator lights described in relation to FIGS. 9-10 are relative to the "first" indicator light described in relation to FIG. 4, and that more or fewer lights could be provided at either end of the cord 10. In some example embodiments, one or more indicator lights may only be provided at one end of the cord 10. In the example embodiment illustrated in FIGS. 9-10, the second indicator light 80*a* and third indicator light 94 are arranged such that there is sufficient space between them that the status indicated by the indicator lights is easily seen by a user. In various example embodiments of the present general inventive concept the body portions of the plugs may be opaque, and may include indicator lights and/or indicia at the surface of the body portion to be seen by users.

Various example embodiments of the present general inventive concept may provide an electrical cord having improved safety features, the electrical cord including a cable having a first electrical wire configured to carry current to a load device, a second electrical wire configured to return current from the load device, and a third electrical wire configured to carry current to a ground connection, a first plug including a first body portion surrounding respective first ends of the first, second, and third electrical wires, a live blade in electrical communication with the first end of the first electrical wire, a neutral blade in electrical communication with the first end of the second electrical wire, and a ground pin in electrical communication with the first end of the third electrical wire, wherein the first body portion surrounds and maintains the live blade, neutral blade, and ground pin in spaced apart orientation corresponding to sockets on an electrical outlet, and a second plug including a second body portion fabricated of an at-least translucent material and surrounding respective second ends of the first, second, and third electrical wires, a live receptacle in electrical communication with the second end of the first electrical wire, a neutral receptacle in electrical communication with the second end of the second electrical wire, a ground receptacle in electrical communication with the second end of the third electrical wire, a first indicator light configured to indicate a state of the electrical cord in which electricity is supplied to the electrical cord, the first indicator light being in electrical communication with the respective second ends of the first and second electrical wires, and a second indicator light configured to indicate a grounded state of the electrical cord at the second plug, the second indicator light being in electrical communication with the respective second ends of the second and third electrical wires, wherein the second body portion surrounds and maintains the live receptacle, neutral receptacle, and ground receptacle in spaced apart orientation corresponding to pins on an electrical plug. The second plug may further include a diode electrically connected in series with the first indicator light between the second end of the first electrical wire and the second end of the second electrical wire, the diode configured to limit the flow of electricity to a normal polarity from the first electrical wire to the second electrical wire, whereby the first indicator light is configured to indicate a normal polarity from the first electrical wire to the second electrical wire. The second plug may further include a first resistor electrically connected in series with the first indicator light and the diode between the second end of the first electrical wire and the second end of the second electrical wire, the second resistor configured to limit the flow of electricity between the second end of the first electrical wire and the second end of the second electrical wire. The second plug may further include a second resistor electrically connected in series with the second indicator light between the respective second ends of the second and third electrical wires, the second resistor configured to limit the flow of electricity from the second end of the second electrical wire and the second end of the third electrical wire. The first indicator light may be configured to indicate a first color, and the second indicator light may be configured to indicate a second color. The first indicator light may be amber, and the second indicator light may be green. Indicia may be provided on the second plug to correspond to the first and second indicator lights and denote indicated states of the electrical cord. The first and second indicator lights may be arranged to be spaced apart in a direction coaxial with the second plug. The first plug may further include a ground pin receptacle in electrical communication in series between the ground pin and the first end of the third electrical wire, the ground pin receptacle defined by a ground pin clip having a forward portion defining an internally threaded through bore configured to engage an externally threaded surface of the ground pin and a rearward portion defining a clamp for establishing mechanical and electrical engagement of the ground pin clip with the third electrical wire. The internally and externally threaded surfaces may define a non-standard thread pattern. The internally and externally threaded surfaces may each define a left-hand thread orientation. The ground pin clip may have a central portion configured to provide reinforcing support for the ground pin to limit deformation or detachment of the ground pin from the ground pin receptacle. The ground pin clip central portion may define a C-shape and a bearing surface disposed rearward of the internally threaded through bore, in axial alignment therewith, the ground pin clip being configured such that the ground pin abuts the bearing surface when the ground pin is fully threadably received within the internally threaded through bore, whereby the C-shape of the central portion encourages rotational moment forces acting on the ground pin to exert force in a direction perpendicular to the bearing surface, thereby limiting deformation of the ground pin receptacle. The first body portion may be fabricated of an at-least translucent material, and may further include a third indicator light configured to indicate a grounded state of the electrical cord at the first plug. The third indicator light may be in electrical communication with the live blade and the ground pin receptacle. The electrical cord may further include a third resistor electrically connected in series with the third indicator light between the live blade and the ground pin receptacle, the third resistor configured to limit the flow of electricity from the live blade to the ground pin receptacle. The first and/or second body portions may be substantially transparent.

From the foregoing description, it will be recognized by one of skill in the art that an electrical cord having plugs with improved safety features is provided herein. It will be appreciated that various embodiments constructed in accordance with various features of the present general inventive concept provide unique advantages over the known prior art. For example, it will be appreciated that embodiments of the present general inventive concept which include the above-discussed ground pin clip 40 and ground pin 38 configuration provide an electrical cord and associated plug having a ground pin which exhibits improved strength over prior art devices, such that the ground pin is very difficult to bend, damage, or break. It will further be appreciated that embodiments of the present general inventive concept which include the above-discussed indicator lights 70, 80 provide an electrical cord in which at least one, and preferably multiple, states of function of the electrical cord may be readily identified by the user. Specifically, it will be appreciated that, in use of embodiments of the present general inventive concept which include the above-discussed indicator lights 70, 80, a user may easily inspect the first and second electrical plugs 32, 56 to confirm multiple electrical states of the cord, namely, whether electricity is supplied to the cord and whether the cord is properly grounded.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein. Numerous variations, modifications, and additional embodiments are possible, and, accordingly, all such variations, modifications, and embodiments are to be regarded as being within the spirit and scope of the present general inventive concept. While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

Having thus described the aforementioned invention, what is claimed is:

1. An electrical cord having improved safety features, the electrical cord comprising:

a cable having a first electrical wire configured to carry current to a load device, a second electrical wire configured to return current from the load device, and a third electrical wire configured to carry current to a ground connection;

a first plug comprising:

a first body portion surrounding respective first ends of the first, second, and third electrical wires, a live blade in electrical communication with the first end of the first electrical wire, a neutral blade in electrical communication with the first end of the second electrical wire, a ground pin in electrical communication with the first end of the third electrical wire, and a ground pin receptacle in electrical communication in series between the ground pin and the first end of the third electrical wire, the ground pin receptacle defined by a ground pin clip having a forward portion defining an internally threaded through bore configured to engage an externally threaded surface of the ground pin and a rearward portion defining a clamp for establishing mechanical and electrical engagement of the ground pin clip with the third electrical wire, the ground pin clip having a central portion configured to provide reinforcing support for the ground pin to limit deformation or detachment of the ground pin from the ground pin receptacle, the ground pin clip central portion defining a C-shape and a bearing surface disposed rearward of the internally threaded through bore, in axial alignment therewith, the ground pin clip being configured such that the ground pin abuts the bearing surface when the ground pin is fully threadably received within the internally threaded through bore, whereby the C-shape of the central portion encourages rotational moment forces acting on the ground pin to exert force in a direction perpendicular to the bearing surface, thereby limiting deformation of the ground pin receptacle, wherein the first body portion surrounds and maintains the live blade, neutral blade, and ground pin in spaced apart orientation corresponding to sockets on an electrical outlet; and a second plug comprising:

a second body portion fabricated of an at-least translucent material and surrounding respective second ends of the first, second, and third electrical wires, a live receptacle in electrical communication with the second end of the first electrical wire, a neutral receptacle in electrical communication with the second end of the second electrical wire, a ground receptacle in electrical communication with the second end of the third electrical wire, a first indicator light configured to indicate a state of the electrical cord in which electricity is supplied to the electrical cord, the first indicator light being in electrical communication with the respective second ends of the first and second electrical wires, and a second indicator light configured to indicate a grounded state of the electrical cord at the second plug, the second indicator light being in electrical communication with the respective second ends of the second and third electrical wires, wherein the second body portion surrounds and maintains the live receptacle, neutral receptacle, and ground receptacle in spaced apart orientation corresponding to pins on an electrical plug.

2. The electrical cord of claim 1, the second plug further comprising a diode electrically connected in series with the first indicator light between the second end of the first electrical wire and the second end of the second electrical wire, the diode configured to limit the flow of electricity to a normal polarity from the first electrical wire to the second electrical wire, whereby the first indicator light is configured to indicate a normal polarity from the first electrical wire to the second electrical wire.

3. The electrical cord of claim 2, the second plug further comprising a first resistor electrically connected in series with the first indicator light and the diode between the second end of the first electrical wire and the second end of the second electrical wire, the second resistor configured to limit the flow of electricity between the second end of the first electrical wire and the second end of the second electrical wire.

4. The electrical cord of claim 3, the second plug further comprising a second resistor electrically connected in series with the second indicator light between the respective second ends of the second and third electrical wires, the second resistor configured to limit the flow of electricity from the second end of the second electrical wire and the second end of the third electrical wire.

5. The electrical cord of claim 1, wherein the first indicator light is configured to indicate a first color, and the second indicator light is configured to indicate a second color.

6. The electrical cord of claim 5, wherein the first indicator light is amber, and the second indicator light is green.

7. The electrical cord of claim 1, wherein indicia are provided on the second plug to correspond to the first and second indicator lights and denote indicated states of the electrical cord.

8. The electrical cord of claim 1, wherein the first and second indicator lights are arranged to be spaced apart in a direction coaxial with the second plug.

9. The electrical cord of claim 1, wherein the internally and externally threaded surfaces define a non-standard thread pattern.

10. The electrical cord of claim 9, wherein the internally and externally threaded surfaces each define a left-hand thread orientation.

11. The electrical cord of claim 4, the first body portion being fabricated of an at-least translucent material, and further comprising a third indicator light configured to indicate a grounded state of the electrical cord at the first plug.

12. The electrical cord of claim 11, the third indicator light being in electrical communication with the live blade and the ground pin receptacle.

13. The electrical cord of claim 12, further comprising a third resistor electrically connected in series with the third indicator light between the live blade and the ground pin receptacle, the third resistor configured to limit the flow of electricity from the live blade to the ground pin receptacle.

14. The electrical cord of claim 1, wherein the second body portion is substantially transparent.

15. The electrical cord of claim 1, wherein the first body portion is substantially transparent.

* * * * *